US007857914B2

(12) United States Patent
Baann

(10) Patent No.: US 7,857,914 B2
(45) Date of Patent: Dec. 28, 2010

(54) METHOD AND DEVICE FOR REMOVING COATINGS ON A METAL STRUCTURE

(75) Inventor: Tom Arne Baann, Stathelle (NO)

(73) Assignee: RPR Technologies AS, Rykkinn (NO)

( * ) Notice: Subject to any disclaimer, the term of this patent is extended or adjusted under 35 U.S.C. 154(b) by 633 days.

(21) Appl. No.: 11/639,501

(22) Filed: Dec. 14, 2006

(65) Prior Publication Data

US 2008/0092919 A1 Apr. 24, 2008

(30) Foreign Application Priority Data

Oct. 19, 2006 (NO) ..... 20064745

(51) Int. Cl.

| | |
|---|---|
| ***H05B 6/02*** | (2006.01) |
| ***H05B 6/06*** | (2006.01) |
| ***H05B 6/10*** | (2006.01) |
| ***C21D 11/00*** | (2006.01) |

(52) U.S. Cl. ..... 134/56 R; 134/57 R; 134/58 R; 219/221; 219/602; 148/567

(58) Field of Classification Search ..... 134/57 R, 134/58 R

See application file for complete search history.

(56) References Cited

U.S. PATENT DOCUMENTS

| | | | | |
|---|---|---|---|---|
| 3,345,874 | A * | 10/1967 | Carniol et al. | 374/177 |
| 3,743,808 | A | 7/1973 | Kasper | |
| 4,371,271 | A * | 2/1983 | Bellet | 374/183 |
| 5,938,965 | A | 8/1999 | Madeira | |
| 6,104,252 | A * | 8/2000 | Hofmann | 331/16 |
| 6,534,767 | B1 * | 3/2003 | Di Maio et al. | 250/338.2 |
| 6,759,910 | B2 * | 7/2004 | Ammar et al. | 331/2 |
| 6,794,622 | B1 * | 9/2004 | Alveberg et al. | 219/635 |

FOREIGN PATENT DOCUMENTS

| | | |
|---|---|---|
| DE | 19940732 | 3/2001 |
| DE | 19940732 A1 * | 3/2001 |
| EP | 0804050 | 10/1997 |
| FR | 2843316 | 2/2004 |

OTHER PUBLICATIONS

Machine Translation: FR 2843316 to Chaty. Aug. 2002.*
Machine translation of DE19940732A1 to Marthen; Jan. 3, 2001.*
Norwegian Search Report for the counterpart foreign application No. 20064745, actual completion of the Norwegian Search date Apr. 5, 2007.
English translation of the abstract of German Patent Publication No. DE19940732.
English translation of the abstract of French Patent Publication No. FR2843316.

* cited by examiner

*Primary Examiner*—Michael Kornakov
*Assistant Examiner*—Natasha Campbell
(74) *Attorney, Agent, or Firm*—Locke Lord Bissell & Liddell LLP

(57) ABSTRACT

A device for removing layers of corrosion and other coatings from a metal surface is disclosed. Said device includes a signal generator driving an induction coil that is positioned on the structure. A control unit includes a temperature sensor that senses the temperature in the metal structure. The control unit is adapted to control the power output of the signal generator in accordance with the temperature in the metal structure.

7 Claims, 4 Drawing Sheets

METHOD AND DEVICE FOR REMOVING COATINGS ON A METAL STRUCTURE

FIELD OF THE INVENTION

Figure 1:
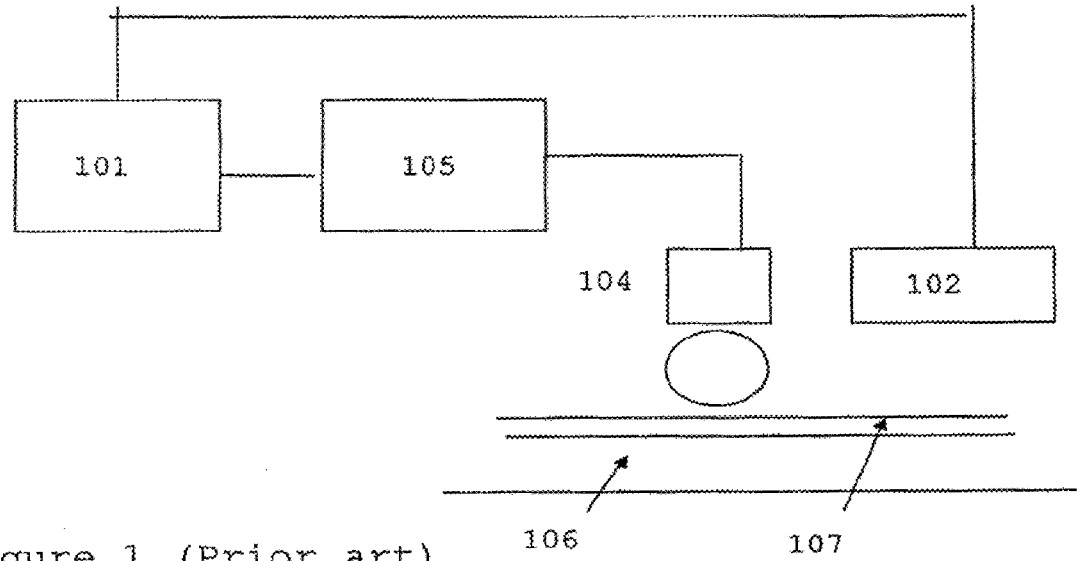
Figure 1 (Prior art)

The present invention relates to a device and method for removing rust and coatings from the surface of metal structures. The invention may find applications in the oil and gas industry for the maintenance of pipelines, offshore oil platforms and chemical and petroleum tanks, in civil engineering for removing rust oil bridges or other large metal structures, or in the maritime sector, e.g. on ships.

TECHNICAL BACKGROUND

From Norwegian patent NO 314296 owned by the present applicant, there is known a device for removing rust and paint on ships' hulls using induction heating. A portable induction heater unit is placed on the hull plate. Said unit includes an induction coil driven by a powerful signal generator. The magnetic field from the induction coil will set up eddy currents in the steel plate, which will be transformed to heat by the ohmic losses in the steel. The heat will lift the paint layers and rust due both to the temperature and differences in expansion coefficients. The supplied heat should be sufficient to lift the paint. However, overheating must be avoided to prevent scorching of the paint and the emission of unpleasant and unhealthy gases. Overheating may also be harmful for objects oil the inside of the plates, in particular if there are any inflammable gases present, and may even anneal the steel and change its properties in a undesirable way. Thus, it is very important to accurately control the supplied heat. The unit disclosed in NO 314296 is moved manually over the hull, and will naturally be moved with an uneven speed. To control the supplied heat, a tachometer wheel is mounted on the unit. The wheel traces the movement and controls the induction field, i.e. the unit is adapted to supply a controlled amount of energy per area. While the prior art system will control the supplied heat in a proper way under ideal conditions, it has a couple of shortcomings. Initially, the system must be manually set to the conditions prevailing on the ship in question, i.e. a mean value must be set that is adapted to the mean thickness of the paint layer. As the workers move to another part of the ship, these conditions may change due to changes in the thickness of the rust and paint, the thickness and the conductivity of the steel.

BRIEF SUMMARY OF THE INVENTION

It is an object of the present invention to provide an improved device for the removal of rust and coatings on metal plates that avoids the shortcoming of prior art devices.

This object is achieved in the invention as claimed in the appended claims. In particular, according to a first aspect, the invention relates to a device for removing layers of corrosion and other coatings from a metal structure, said device including a signal generator driving an induction coil that is positioned on the structure and a control unit including a temperature sensor sensing the temperature in the metal structure and which is adapted to control the power output of the signal generator in accordance with the temperature in the metal structure.

According to a second aspect, the invention relates to a method for removing layers of is corrosion and other coatings on a metal structure. Said method includes inducing a strong alternating eddy current in the structure, determining the temperature at the surface of the metal structure and controlling the power of the induced current in accordance with said temperature.

Other advantageous embodiments of the invention appear from the appended dependent claims.

THE DRAWINGS

Figure 2:
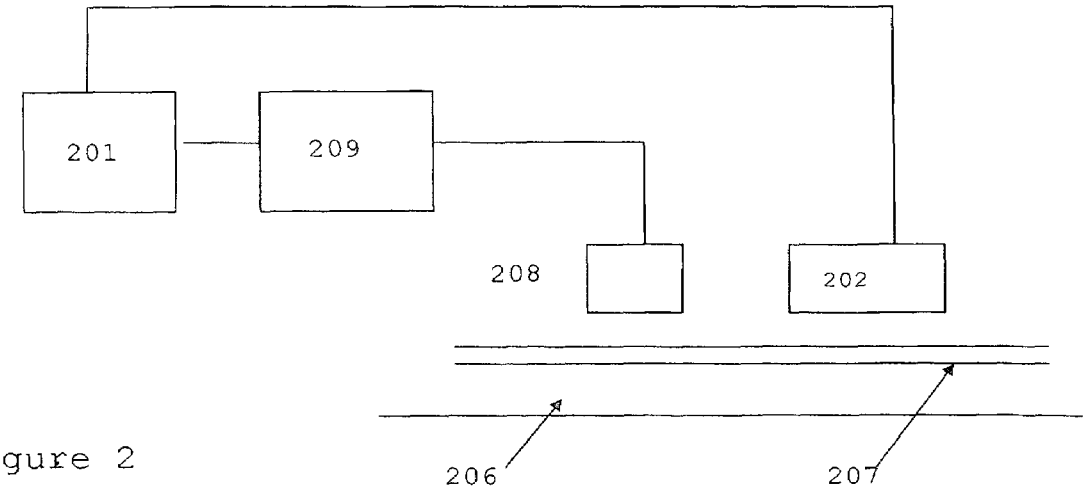
Figure 3:
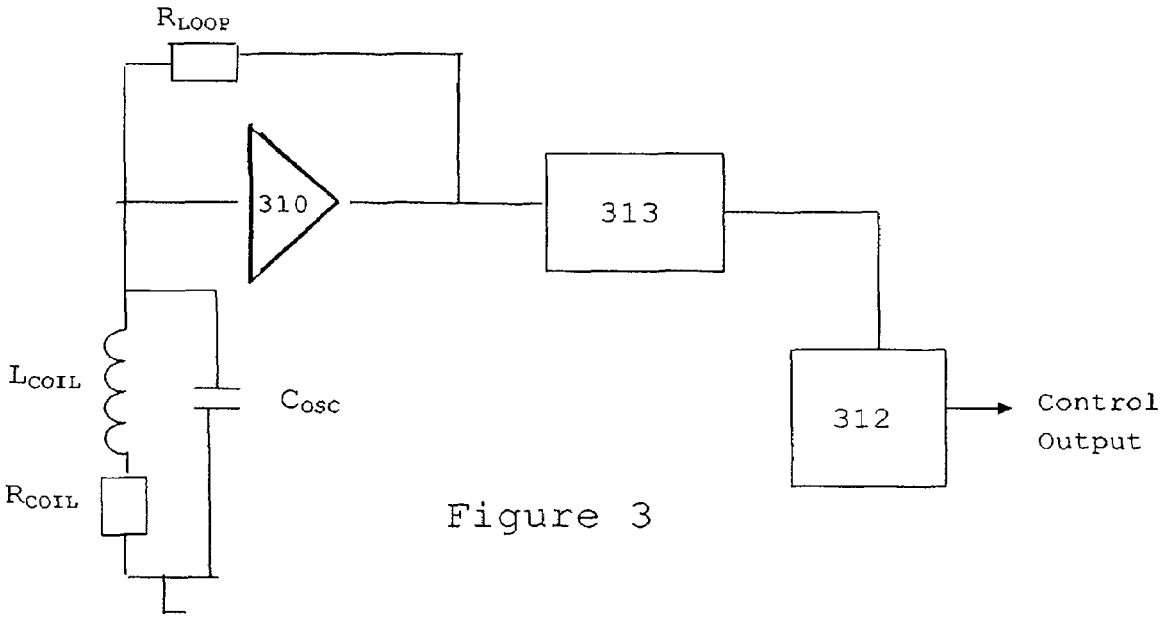
Figure 4:
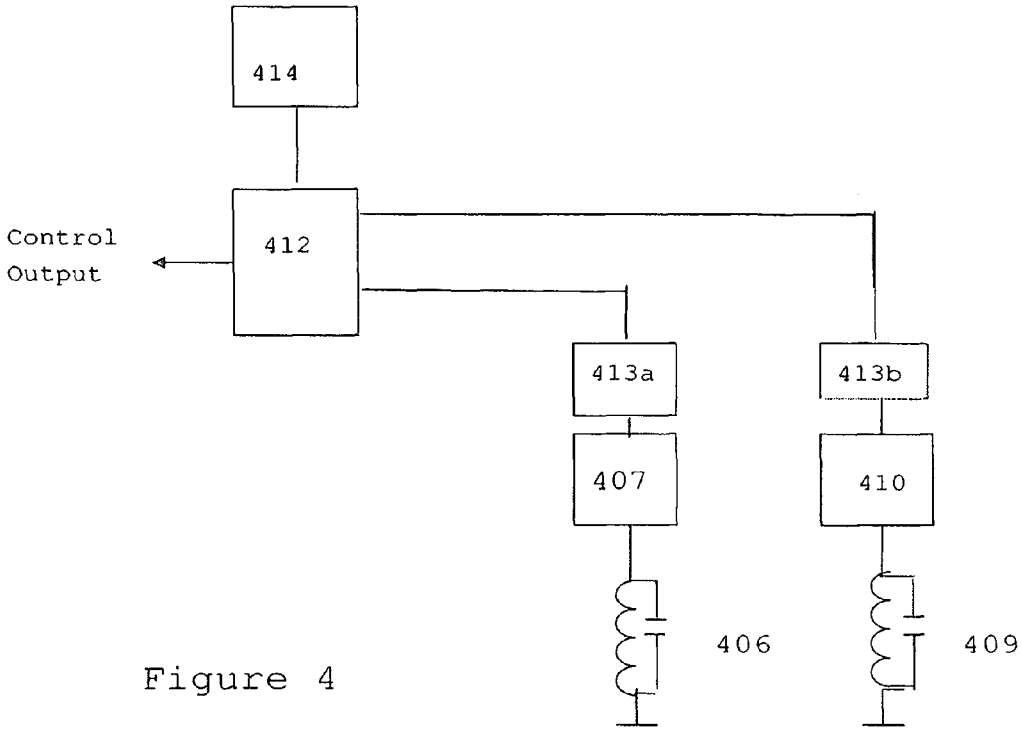
Figure 5:
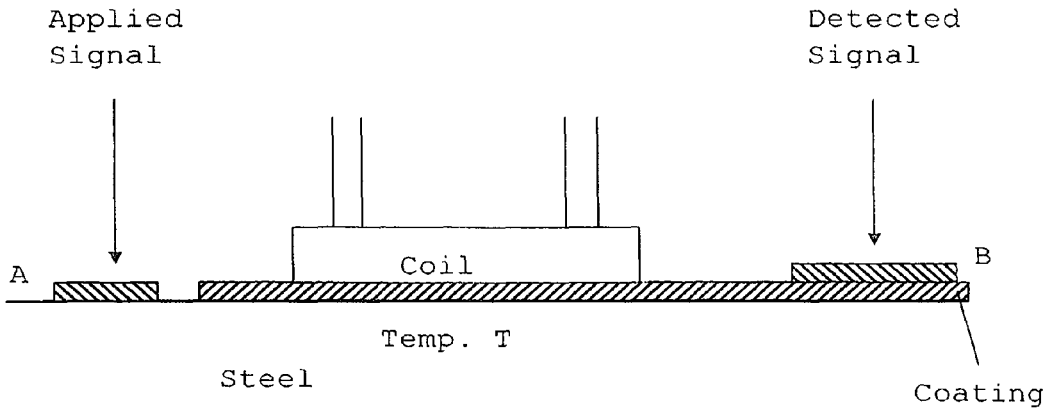

The invention will now be described in relation to the appended drawings, in which FIG. 1 is a schematic block diagram showing the main components of a prior art device for removal of rust and coatings, FIG. 2 is a schematic diagram over a corresponding device according to the present invention, FIG. 3 is a diagram showing a temperature sensor for use in the device in FIG. 2, FIG. 4 is an alternative embodiment of the temperature sensor in FIG. 3, FIG. 5 is an alternative temperature sensor for use in the device illustrated in FIG. 2.

DETAILED DESCRIPTION

A prior art device for removing rust and paint is shown in FIG. 1. In use, the device is positioned on a metal surface that is coated with a layer of paint and rust 107. This layer may of course include other coatings as well, such as epoxy coatings, rubber, fire-retardant and other various coatings for preventing fouling of ships hulls, etc. A power supply unit 101 drives a coil 102. The power supply unit 101 acts as a power signal generator delivering a strong AC signal. The coil 102 will set up an alternating magnetic field in the metal structure. The magnetic field will induce an eddy current in the metal sheet 106 which will heat the metal. To control the heat induced in the steel, e.g. if the device is held stationary for a moment, a tachometer 104 or other motion sensor measures the rate of displacement of the device. A logic unit 105 reads the output from the tachometer 104 and the power delivered from the power supply unit 101. A control signal is produced and sent to the power supply unit. 101. This prior art device is adapted to supply a constant amount of heat per area of the metal surface.

FIG. 2 shows a corresponding device designed according to the present invention. The device includes a power supply unit 201 driving a coil 202, as in the prior art device. However, this device includes a temperature sensor 208 that senses the temperature in the metal sheet 206 beneath the device. A microcontroller 209 reads the output from the temperature sensor 208 and the power delivered from the power supply unit 201. An algorithm is used to find the appropriate power required, which is compared with the actual power output. A control signal is produced and sent to the power supply unit 201. Then the temperature in the plate always may be held within a window of acceptable values, irrespective of local variables such as the thickness of the plate or the presence of objects at the inside of the sheet.

The temperature sensor 208 must be able to measure the temperature in the metal sheet 206 beneath the coating 207. This precludes the use of devices based on measuring temperatures on the surface, such as off the shelf infrared ray detectors. This requirement has dictated the development of temperature sensors suited for this application.

FIG. 3 illustrates an inductive temperature sensor circuit. The sensor includes an oscillator circuit whose frequency is determined by a resonant circuit made of a coil $L_{COIL}$ and a parallel capacitance $C_{OSC}$. The oscillator circuit is connected to the microcontroller 312.

The coil $L_{COIL}$ is a conventional air-cored inductor, which when driven by a signal, couples electromagnetically to the sheet of metal. If the sensor is placed in close proximity of a steel structure, the oscillator coils will be affected by the steel corresponding to an iron core in a common resonator coil, increasing their inductivity. The invention is applicable for other metals as well provided they have magnetic properties.

The oscillator circuit consists of the corresponding coil $L_{COIL}$, connected via shielded cable to a parallel capacitance $C_{OSC}$ and a very high gain non-inverting amplifier 310. The circuit oscillates at the natural resonant frequency of the LC combination, where the loop phase shift is zero and thus positive feedback occurs.

The output of the oscillator is nominally a digital square wave with frequency:

$$f = \frac{1}{2\Pi}\sqrt{\left(\frac{1}{L_{COIL}C_{OSC}} - \frac{R_{COIL}^2}{L_{COIL}^2}\right)}$$

where $L_{COIL}$ is the inductance of the coil, $R_{COIL}$ is the loss in the circuit and $C_{OSC}$ is the capacitance of the external capacitor. $C_{OSC}$ has of course also some internal losses, but they are generally negligible compared with the losses in the coil and is not included in the formula.

$L_{COIL}$ is affected by the metal sheet, as is $R_{COIL}$. The oscillator will induce a weak eddy current in the metal and the losses in this circuit are also included in $R_{COIL}$. The losses in the metal sheet are dependent on temperature, and therefore the actual frequency of the oscillator will change in response to the temperature. The proximity of the metal sheet will also affect the inductance of the coil and thus the frequency of the oscillator, but the distance to the metal is here assumed to be constant, why this parameter may be ignored.

The fact that the inductance also is dependent on the proximity to the metal implies that this circuit may also be used to measure the distance to the metal sheet, provided that the temperature is held constant.

For best performance, heavy gauge wire should be used in the coil to reduce the internal $R_{COIL}$. In addition, $C_{OSC}$ should have a small temperature coefficient. These measures provide for low temperature drift in the oscillator.

The resistance $R_{LOOP}$ in the feedback loop is ideally set such that it is equal to the impedance of the LC tank at resonance, thus giving the largest possible signal at the amplifier input and thereby minimising the effect of noise.

Noise at the amplifier input is translated into timing jitter in the square wave output, affecting both the frequency and the duty cycle of the output. Therefore the oscillator output signal is passed to a Phase Locked Loop IC 313, which effectively removes the jitter.

The microcontroller 312 observes the outputs from the PLL 313. The microcontroller is adapted to calculate the temperature of the metal from these data.

To improve the noise immunity, the microcontroller may average several temperature readings.

To improve the stability and accuracy of the temperature sensor, a reference oscillator may be incorporated in the circuit, as illustrated in FIG. 4. This circuit includes a first oscillator 407 and a second oscillator 410 with resonance circuits 406 and 409, respectively. The oscillators are positioned on the metal; the first oscillator is placed in the hot zone beneath or near the induction heater, while the second oscillator is placed in the cold zone outside the area affected by the induction heater. The signal from each oscillator is sent to a microcontroller unit 412 that counts and compares the frequencies of the oscillators. For each signal it measures the time required for 200 oscillations to occur. The time is measured in processor clock cycles. The microcontroller 412 then displays these data on a display device 414. This is the microcontroller denoted as 209 in FIG. 2, and 312 in FIG. 3. The microcontroller is adapted to produce an output signal that is used to control the signal generator in the induction unit, as explained above. The circuit may include phase locked loops 413 a, b for removing jitter.

An alternative method for measuring the temperature in the metal is illustrated in FIG. 5. The method is based on measuring the propagation speed of ultrasonic waves in the metal.

The applied signal at the transducer A is creating an ultrasound wave travelling from A to the detector at point B. The applied signal could either be a single pulse or a signal with a frequency swept between the two frequencies $fa_1$ and $fa_2$.

This ultrasound wave is passing under the heating coil which is creating the temperature T. The detected signal at B is measured either in the time domain as a time delay from A to B or in the frequency domain.

The delay or the measured frequency spectrum will be an unambiguous function of the average temperature T in the heated area under the coil.

The methods used for determining the temperature in the metal sheet may find other applications than in devices for removing coating on metal. In the industry, there may often be a need for determining temperature in a metal structure that is not readily visible, i.e. being beneath a covering or coating of some kind, where these methods may be used with advantage.

The invention claimed is:

1. A device for removing layers of corrosion and/or other coatings from a metal structure, said device comprising a signal generator;

an induction heating coil coupled to the signal generator that is positioned on the metal structure;

a control unit; and a temperature sensor coupled to the control unit, which is adapted to measure the temperature in the metal structure beneath the layers of corrosion and/or other coatings;

wherein the control unit regulates the power output of the signal generator in accordance with the temperature in the metal structure.

2. A device as claimed in claim 1, wherein said device includes: an oscillator with a resonance circuit including a coil and a capacitor, the resonance circuit being positioned on a heated part of the metal structure, said control unit being adapted to determine the oscillation frequency of the oscillator and produce a controlling signal which is a function of said frequency.

3. A device according to claim 1, wherein the temperature sensor comprises:

a first oscillator with a first resonance circuit including a first resonance coil and a first resonance capacitor, wherein the first resonance circuit is positioned on a heated part of the metal structure, a second oscillator with a second resonance circuit including a second resonance coil and a second resonance capacitor, wherein the second resonance circuit is positioned on an unheated part on the metal structure, whereby said control unit being adapted to determine the difference between the frequencies of the first and second oscillators and produce a controlling signal which is a function of the difference between said frequency values.

4. A device according to claim 3, wherein the control unit includes a clock, and is adapted to estimate said frequencies by counting a predefined number of oscillator periods in clock cycles.

5. A device according to claim 4, wherein the device includes first and second phase locked loops arranged to receive an output signal from the first and second oscillator, respectively, and deliver a cleaned up version of the signals to the control unit.

6. A device according to claim 5, wherein the control unit is adapted to sum a number of readings of frequency differences, and compute an average of said frequency differences.

7. A device according to claim 1, wherein said device includes: a first transducer (A) adapted to transmit an ultrasonic signal into the metal structure, a second transducer (B) adapted to receive said ultrasonic signal, a processor unit connected to said first and second transducers and which is adapted to determine the temperature in the metal structure.

* * * * *